US007490406B2

(12) United States Patent
Shook

(10) Patent No.: US 7,490,406 B2
(45) Date of Patent: Feb. 17, 2009

(54) BICYCLE WHEEL RIM WITH INTERNALLY REINFORCED SPOKE SEATS AND METHOD FOR PRODUCING THEM

(76) Inventor: William Shook, 3917 E. Eden Rock Cir., Tampa, FL (US) 36534

( * ) Notice: Subject to any disclaimer, the term of this patent is extended or adjusted under 35 U.S.C. 154(b) by 213 days.

(21) Appl. No.: 11/122,578

(22) Filed: May 4, 2005

(65) Prior Publication Data

US 2006/0248721 A1 Nov. 9, 2006

(51) Int. Cl.
*B21K 1/38* (2006.01)
*B60B 21/00* (2006.01)

(52) U.S. Cl. ..... 29/894.35; 29/894.353; 301/58; 301/95.107; 301/95.108

(58) Field of Classification Search ..... 29/894.33, 29/894.34, 894.342, 894.35, 894.353; 301/58, 301/95.101, 95.107, 95.108, 104, 110.5
See application file for complete search history.

(56) References Cited

U.S. PATENT DOCUMENTS 1,286,065 A * 11/1918 Murray ..... 301/58
2,937,905 A * 5/1960 Altenburger ..... 301/58
5,499,864 A * 3/1996 Klein et al. ..... 301/95.104
5,651,591 A * 7/1997 Mercat et al. ..... 301/95.108
6,216,344 B1 * 4/2001 Mercat et al. ..... 29/894.351
6,224,165 B1 * 5/2001 Mercat et al. ..... 301/58
6,234,580 B1 5/2001 Muraoka et al.
6,257,676 B1 * 7/2001 Lacombe et al. ..... 301/58
6,283,557 B1 9/2001 Okajima et al.
6,378,953 B2 * 4/2002 Mercat et al. ..... 301/95.106
6,402,256 B1 6/2002 Mercat
6,443,533 B2 * 9/2002 Lacombe et al. ..... 301/95.104
6,536,849 B1 3/2003 Okajima et al.
6,846,047 B2 * 1/2005 Dietrich ..... 301/58
7,063,392 B2 * 6/2006 Chen ..... 301/95.108
7,137,671 B2 * 11/2006 Passarotto et al. ..... 301/58
7,140,695 B2 * 11/2006 Passarotto ..... 301/58
2003/0025383 A1 * 2/2003 LaCombe et al. ..... 301/95.101

FOREIGN PATENT DOCUMENTS

WO WO 93/09963 * 5/1993

* cited by examiner

*Primary Examiner*—Essama Omgba
(74) *Attorney, Agent, or Firm*—John C. Purdue; David C. Purdue

(57) ABSTRACT

Bicycle wheel rims with internally reinforced spoke seats are disclosed along with methods for producing them. The rims are produced from a rim blank with at least one circumferentially extending spoke attachment region that has a relatively uniform given thickness. Access holes are formed in an upper web of the rim blank and tooling is positioned above and below the spoke attachment region to form a reinforced spoke seat and a spoke hole therein. Material that is upset and moved from the location of the spoke hole is displaced into an annular region where it reinforces the spoke hole. Material in the vicinity of the spoke hole can be displaced towards the inside of the rim and material can be removed from the undisplaced portions of the spoke region leaving a reinforced area around the spoke hole.

6 Claims, 3 Drawing Sheets

BICYCLE WHEEL RIM WITH INTERNALLY REINFORCED SPOKE SEATS AND METHOD FOR PRODUCING THEM

BACKGROUND OF THE INVENTION (1) Field of the Invention

The present invention relates generally to rims for wheels for human powered vehicles such as bicycles, wheel chairs and the like, and especially to novel rims with reinforced spoke seats and methods for producing them.

(2) Description of Related Art Including Information Disclosed Under 37 CFR 1.97 and 37 CFR 1.98

A great deal of effort has been directed to reducing the weight of rims for wheels for human powered vehicles and especially bicycle wheel rims. Bicycle wheel rims are typically produced by extruding aluminum alloy or the like to produce a linear extrusion having a cross section corresponding with the finished rim, rolling the extrusion into a circular shape, cutting the extrusion to length and connecting the free ends with pins, plugs or welds. In a finished wheel, the greatest stresses on the rim are concentrated where spokes that support the rim relative the hub of the wheel are supported on or connected to the rim at spoke connection points or spoke seats. As a consequence, if a rim is uniformly shaped about its circumference, the areas between the spoke connection points will be thicker and heavier than they need to be in order for the spoke connection points along the rim to be strong enough to withstand the stresses they encounter. This means that the rim will be heavier than it needs to be. No small inventive effort has been directed at making rims lighter overall but reinforcing rims at spoke connection points and using inserts adapted to distribute the stresses on the rim that are caused by the spokes, thereby lightening the rim.

U.S. Pat. No. 6,402,256 discloses a rim with a nominal wall thickness in spoke boring zones and a wall thickness in intermediate zones between boring zones that is less than the nominal thickness. Between the boring zones and the intermediate zones, transitional zones of the rim wall have a thickness that varies progressively from the nominal thickness to the thickness of the intermediate zone. According to the patent, the rim is produced by producing a rim blank and machining portions of the outside surface of the rim wall to create the intermediate zones and the transitional sections, leaving the original, nominal thickness of the rim in the boring zones.

Other patents disclose rims with wall sections that are thickened to withstand the forces exerted on the rims by spokes under tension. For example, U.S. Pat. No. 6,283,557 discloses a rim with circumferential rings 68 of increased thickness in spoke attachment zones. U.S. Pat. No. 6,536,849 discloses a rim with sections of increased thickness where spokes are attached to the rim and an internal ridge that may strengthen the rim.

U.S. Pat. No. 6,234,580 discloses several embodiments of rims with reinforced spoke seats, including some that appear to be impossible to produce.

BRIEF SUMMARY OF THE INVENTION

The present invention is a bicycle wheel rim including reinforced spoke seats and methods for producing such rims. Rim blanks for use in the methods of the present invention can be produced by extruding a suitable alloy into a rim profile, rolling the extrusion, cutting the rolled extrusion to length and joining the free ends to produce a rim blank having at least one circumferentially extending spoke attachment region that has a relatively uniform given thickness. According to the invention, access holes are then formed in the rim opposite the spoke hole locations, for example, in an upper web of the rim, tooling is positioned above and below the spoke attachment region and the tooling is manipulated to form a reinforced spoke seat and a spoke hole therein.

Accordingly, it is an object of the present invention to provide an improved rim for bicycle wheels.

It is a further object of the invention to provide a simple method for producing an improved rim with a reinforced spoke seat.

It is a further object of the present invention to provide a rim having a circumferentially extending spoke region and having internally reinforced spoke seats therein.

It is yet a further object of the invention to provide a rim with reinforced spoke seats wherein the reinforcement is not visible from the outside of the rim.

These and other objects and advantages of the present invention will be fully appreciated by those skilled in the art upon reviewing the disclosures herein.

DETAILED DESCRIPTION OF THE PREFERRED EMBODIMENTS

Figure 1:
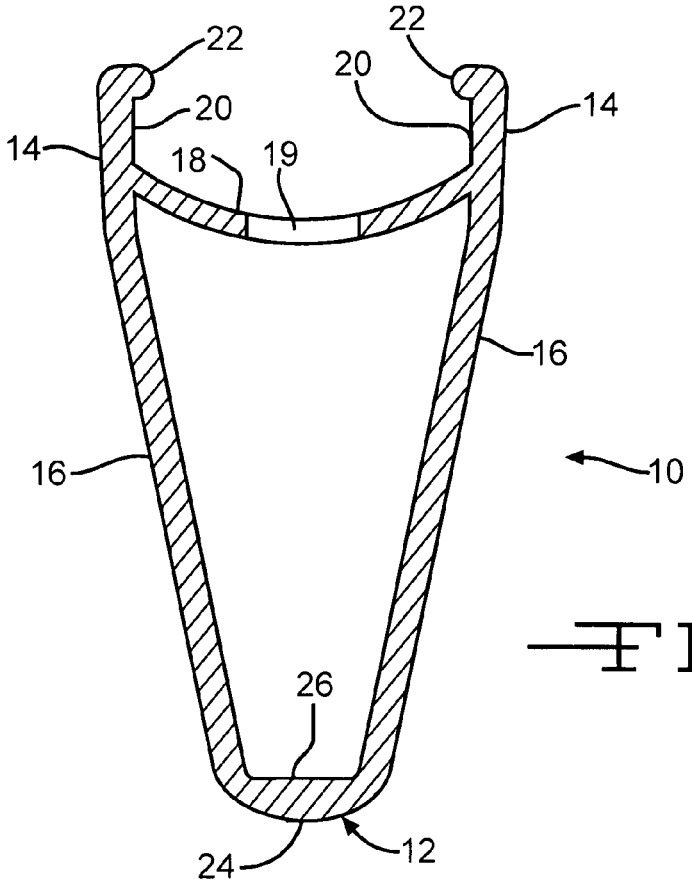
FIG. 1 is a cross-sectional view of a rim blank for producing a rim according to the present invention.

Referring to FIG. 1, a rim blank indicated at 10 comprises a circumferentially extending spoke region or spoke bed 12, two opposed brake surfaces 14 and two opposed side walls 16 extending between the spoke bed 12 and the brake surfaces 14. A transverse flange or upper web 18 extends between the upper portions of the extrusion 10, adjacent to the brake surfaces 14. An access hole, indicated at 19, is formed in the transverse flange or upper web 18. The access hole 19 provides tooling access that is required in some of the methods described below. Tire flanges 20 extend upwardly from the transverse flange 18 and terminate in tire bead hooks 22. The spoke region 12 has an outer or lower surface 24 and an inner or upper surface 26.

Figure 2:
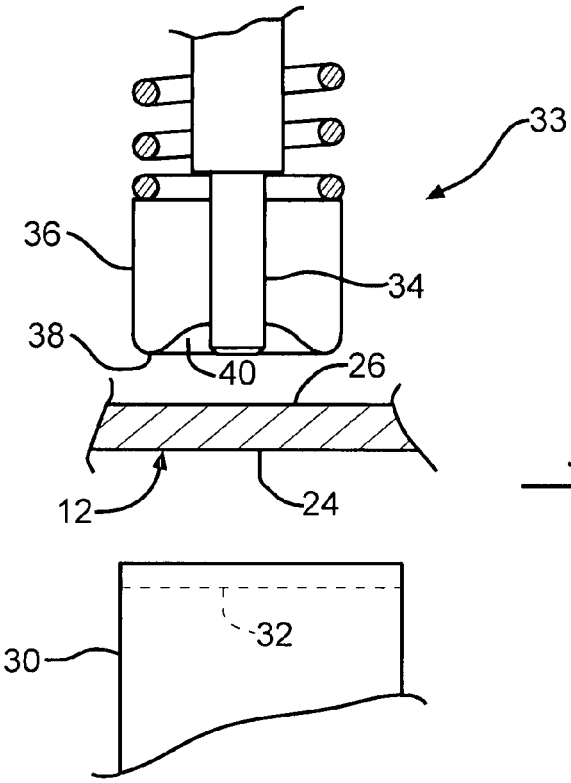
FIG. 2 is a side view, in cross section, of a circumferentially extending spoke region of the rim blank shown in FIG. 1 with a first set of tooling above and below the spoke region.

In FIG. 2, tooling is shown for upsetting metal in a portion of the spoke region, in the vicinity of a spoke hole (not shown in FIG. 2) to be formed in the rim blank 10 (FIG. 1). An anvil 30 is positioned below the spoke region 12 and it has a recess with a low point 32. The anvil recess is configured to receive and support the spoke region 12, specifically, to support the outside or lower surface 24 of the spoke region 12. According to the method of the present invention, the anvil 30 and the spoke region 12 are brought together until the outside surface 24 of the spoke region 12 is firmly supported in the recess of the anvil 30. With the spoke region 12 seated on the anvil 30, a tool, indicated generally at 33, is brought into contact with the inner surface 26 of the spoke region 12. The tool 33 comprises a central plunger 34 and a forming collar 36 therearound. The forming collar 36 comprises a circumferential shoulder 38 and a forming cavity 40 at its lower end.

As the tool 33 advances towards the anvil, the shoulder 38 and the plunger 34 contact the inner surface 26 of the spoke region 12 which is then held captive between the tool 33 and the anvil 30. The central plunger 34 is then advanced beyond the shoulder 38 and into the material constituting the spoke region 12, thereby upsetting material outwardly from the plunger 34. As the plunger 34 advances, the anvil 30 and the shoulder 38 cooperate to cause upset material to move into the cavity 40. There is simply no other place for the upset material to go. It is preferred that the plunger 34 have a diameter corresponding with the diameter desired for a spoke hole and that the advancement of the plunger 34 be stopped before the plunger 34 reaches the anvil 30, thereby producing a modified spoke region 12' (FIG. 3) with a thickened annular region 42 surrounding a spoke hole pre-form indicated at 44. The outer surface 24 of the spoke region 12' corresponds with the outer spoke surface 24 of the spoke region 12 because the anvil 30 prevents deformation of the outer surface 24 during the time that the tool 33 is acting on the spoke region 12. The inner surface 26 of the spoke region 12 is transformed by the tool 33 into the inner surface 26' shown in FIG. 3 that includes the raised or thickened annular portion 42.

Figure 3:
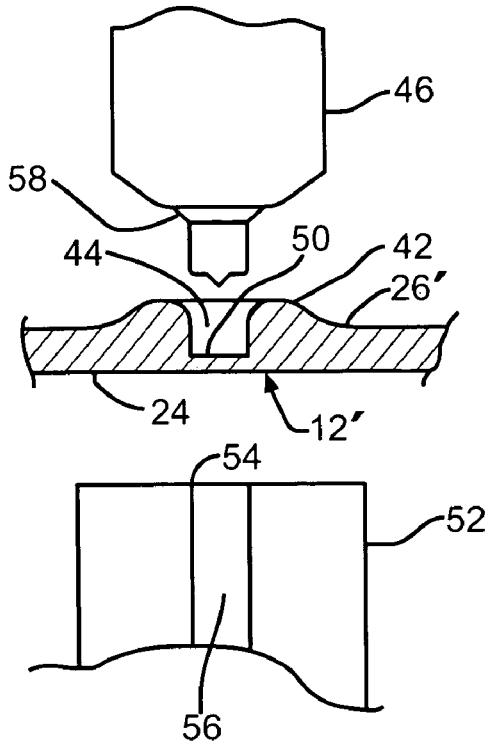
FIG. 3 is a side view, in cross section, of the spoke region shown in FIG. 2 after the tooling showing in FIG. 2 has acted on the spoke region, and showing a second set of tooling above and below the spoke region.
Figure 4:
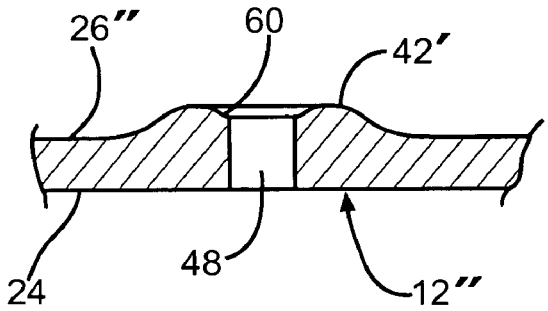
FIG. 4 is a side view, in cross-section, of the spoke region shown in FIG. 3 after the tooling in FIG. 3 has acted on the spoke region.

A punch 46 is shown in FIG. 3 poised to complete the formation of a spoke hole that is indicated at 48 in FIG. 4. The punch 46 is operable to remove a small, thin web of material 50 that remains in the spoke region 12' below the spoke hole pre-form 44. The punch 46 cooperates with an anvil 52 that includes an annular shoulder 54 surrounding a bore indicated at 56. The outer surface 24 of the spoke region 12' is brought into contact with the anvil 52 so that the shoulder 54 is centered around the spoke hole pre-form 44. The punch 46 is advanced towards the anvil 52, into the spoke hole pre-form 44 and through the thin web 50, thereby removing the thin web 50 and producing the spoke hole indicated at 48 in FIG. 4. The punch 46 includes a shoulder 58 that forms a seat 60 around the spoke hole 48 for receiving a spoke head (not shown) or a spoke nipple (not shown) or the like. The punch 46 is operable to transform the inner surface 26' (FIG. 3) into the finished inner surface 26" (FIG. 4).

Referring now to FIG. 4, the completed spoke region 12" has an outer surface 24 corresponding with the outer surface 24 of the spoke region 12 (FIGS. 1 through 3), a spoke hole indicated at 48, a thickened, internally raised annular region 42" and a seat 60 formed in the annular region 42". The annular region 42" serves to reinforce the spoke region 12" around the spoke hole indicated at 48. On either side of the annular region 42', as seen in FIG. 4, the spoke bed has the same thickness as the spoke bed 12 shown in FIGS. 1 and 2. Moreover, the outer surface 24 of the spoke region 12" gives no indication that the area immediately surrounding the spoke hole indicated at 48 is reinforced by the thickened annular region 42' because it extends inwardly from the inner surface 26" and is not seen from the outside of the rim blank 10.

Figure 5:
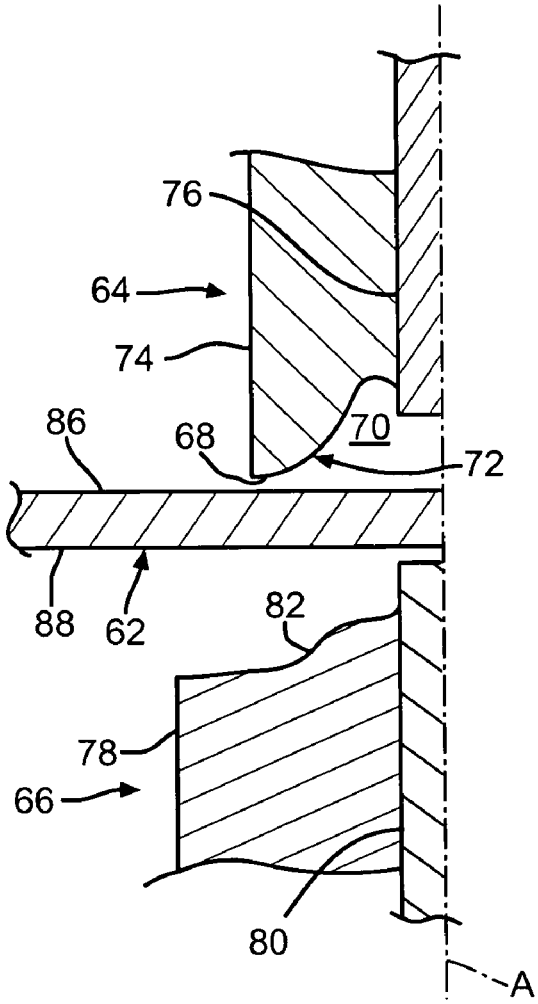
FIG. 5 is a side view, in cross-section, of a circumferentially extending spoke region of the rim blank shown in FIG. 1 with a third set of tooling above and below the spoke region.
Figure 6:
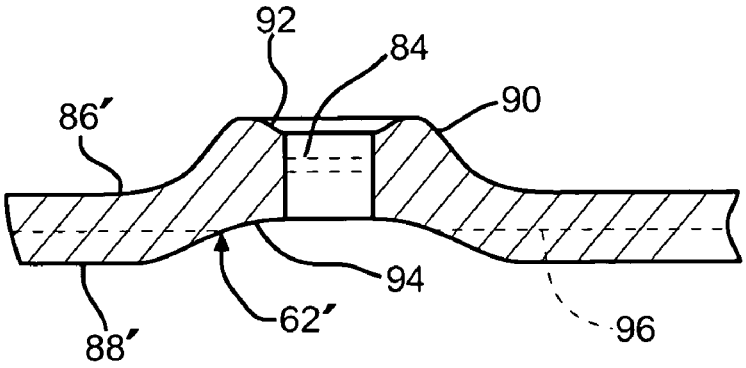
FIG. 6 is a side view, in cross section, of the spoke region shown in FIG. 5 after the tooling in FIG. 5 has acted on the spoke region.

Referring now to FIGS. 5 and 6, a second method for producing a rim with a reinforced spoke hole will now be described. Like the method described previously, this method produces a rim blank with an internally reinforced spoke hole wherein the reinforcement is not apparent when viewing the rim blank from the outside.

In FIG. 5, tooling is shown for upsetting metal in a portion of a spoke region 62 of a rim blank (not shown). Actually, half of the tooling and half of the spoke region 62 are shown because the other halves are mirror images of the halves that are shown with symmetry about an axis A. The tooling comprises an upper punch tool 64 and a lower punch tool 66. The upper punch tool 64 includes an annular shoulder 68 surrounding a cavity indicated at 70, which is defined by a forming surface 72 in an outer tool member 74. A punch 76 is centrally located in the outer tool member 74 for reciprocating movement relative to the outer tool member 74. The lower punch tool 66 comprises an outer tool member 78 and a punch 80 centrally located in the outer tool member 78 for reciprocating movement relative to the outer tool member 78. A forming surface 82 is provided on the outer tool member 78.

From the positions shown in FIG. 5, the upper punch tool 64 and the lower punch tool 66 are advanced towards each other to forge or upset the material of the spoke region 62 that is between the upper and lower punch tools 64 and 66, until the spoke region 62 has assumed the configuration shown for modified spoke region 62' as shown in FIG. 6. At that point, there will be a slug of material (not shown) between the punch 76 and the punch 80 which has to be removed in order to complete the formation of a spoke hole 84 (FIG. 6) in the spoke region 62'. This is accomplished by retracting the punch 80 away from the spoke region 62 and advancing the punch 76 towards and through the spoke region 62 while maintaining the outer tool member 74 and the outer tool member 78 pressed tightly against an upper surface 86 and a lower surface 88, respectively, of the spoke region 62.

Referring now to FIG. 6, the completed spoke region 62' comprises a modified upper surface 86', a modified lower surface 88', the spoke hole indicated at 84, a thickened, internally raised annular region 90 and a seat 92 formed in the annular region 90. On the modified lower surface 88', there is a recessed portion 94 that is created by the action of the forming surface 82 of the outer tool member 78 on the lower punch tool 66. On the modified upper surface 86', the thickened annular region 90 serves to reinforce the spoke region 62' around the spoke hole indicated at 84. On either side of the annular region 90, as seen in FIG. 6, the spoke bed or spoke region 62' has the same thickness as the spoke bed or spoke region 62 shown in FIG. 5. In this embodiment, it is contemplated that the thickness of the spoke region 62, before it is upset by the tools 64 and 66, is greater than the thickness required for it in between spoke holes in the finished rim. Accordingly, after the spoke region 62 has been reworked into the modified spoke region 62', material can be removed from the spoke region 62' until the modified lower surface 88' is made to be flush or substantially flush with the recessed portion 94 of the modified spoke region 62' as indicated at 96. This removal of material can be accomplished mechanically, as by abrasion or cutting or by other suitable means known in the art. It is preferred that, when the removal of material is completed, the lower surface of the spoke region has a uniform surface that does not give away the fact that the spoke hole is reinforced internally.

In the embodiment described above with reference to FIGS. 5 and 6, it will be appreciated that an internally reinforced spoke hole can be produced even if the internally raised annular shoulder 90 is not thicker than the adjacent unworked portions of the spoke region 62'. In other words, if the upper and lower punch tools are configured so that they indent but do not thicken the annular region around what will become the spoke hole, that annular region will be thicker and thus reinforced, by comparison with adjacent portions of the spoke region 62' after material is removed from the lower surface of the spoke region to make it flush, or substantially flush, with the recessed portion 94.

The foregoing detailed description sets forth the best mode known to the inventor for carrying out the invention and is intended to enable one of ordinary skill in the art to practice the invention. In practice, however, the invention is not necessarily limited to the exact details of the embodiments described above but is susceptible of variations and departures therefrom within the spirit and scope of the invention as it is defined in the appended claims.

The invention claimed is:

1. A method for producing a reinforced portion of a spoke region in a rim for a wheel where the rim comprises a pair of side walls, an upper web connecting the side walls and a spoke region with a lower, outer surface and an upper, inner surface, said method comprising the steps of forming a recess in the spoke region in the vicinity of the portion to be reinforced by advancing a tool into contact with the lower surface so that the recess has a recessed lower surface and removing material from the lower surface of the spoke region adjacent to the portion to be reinforced to create a new lower surface that is substantially flush with the recessed lower surface of the recess, whereby the reinforced portion of the spoke region has a given thickness and the spoke region adjacent to and surrounding the reinforced portion has a thickness that is less than the given thickness.

2. The method claimed in claim 1 wherein the removal of material from the lower surface is controlled so that the lower surface of the spoke region is uniform in the reinforced portion and in the spoke region adjacent to the reinforced portion.

3. The method claimed in claim 1 including the further step of forming an annular shoulder in the reinforced portion by thickening a portion of the spoke region with cooperating tooling acting on the upper and lower spoke region surfaces.

4. A method for producing a reinforced portion of a spoke region in a rim for a wheel where the rim comprises a spoke region with a lower, outer surface and an upper, inner surface, said method comprising the steps of supporting the lower surface of the spoke region in the portion to be reinforced while advancing a plunger into and through the upper surface of the spoke region in the portion to be reinforced so that material is upset and caused to flow away from the plunger and restricting the material that is caused to flow away from the plunger by containing it within a forming cavity, wherein the forming cavity is operable to form a thickened, reinforced annular shoulder around a hole formed by the plunger.

5. The method claimed in claim 4 wherein the lower surface of the spoke region is supported while the method is carried out so that the thickened reinforced annular shoulder is not evident from outside of the rim.

6. The method claimed in claim 4 including the further steps of forming a recess in the spoke region in the vicinity of the portion to be reinforced by advancing a tool into contact with the lower surface so that the recess has a recessed lower surface and removing material from the lower surface of the spoke region adjacent to the portion to be reinforced to create a new lower surface that is substantially flush with the recessed lower surface of the recess.

* * * * *